US010386877B1

(12) United States Patent
Magen

(10) Patent No.: US 10,386,877 B1
(45) Date of Patent: Aug. 20, 2019

(54) LDO REGULATOR WITH OUTPUT-DROP RECOVERY

(71) Applicant: Nuvoton Technology Corporation, Hsin-chu (TW)

(72) Inventor: On Magen, Yaaf (IL)

(73) Assignee: Nuvoton Technology Corporation, Hsin-chu (TW)

( * ) Notice: Subject to any disclaimer, the term of this patent is extended or adjusted under 35 U.S.C. 154(b) by 0 days.

(21) Appl. No.: 16/159,665

(22) Filed: Oct. 14, 2018

(51) Int. Cl.
*G05F 1/575* (2006.01)
*G05F 1/565* (2006.01)

(52) U.S. Cl.
CPC ..... *G05F 1/575* (2013.01); *G05F 1/565* (2013.01)

(58) Field of Classification Search
CPC . G05F 1/56; G05F 1/565; G05F 1/569; G05F 1/575; G05F 1/59
See application file for complete search history.

(56) References Cited

U.S. PATENT DOCUMENTS

| | | | | |
|---|---|---|---|---|
| 5,672,959 | A | 9/1997 | Der | |
| 5,864,227 | A | 1/1999 | Borden et al. | |
| 6,046,577 | A | 4/2000 | Rincon-Mora et al. | |
| 6,201,375 | B1 | 3/2001 | Larson et al. | |
| 7,095,215 | B2 * | 8/2006 | Liu | H02M 1/32 323/222 |
| 7,199,565 | B1 | 4/2007 | Demoli | |
| 7,450,916 | B1 | 11/2008 | Hietala et al. | |
| 7,498,780 | B2 | 3/2009 | Chen et al. | |
| 8,193,798 | B1 | 6/2012 | Pace et al. | |
| 8,258,875 | B1 | 9/2012 | Smith et al. | |
| 8,436,595 | B2 | 5/2013 | Simmons et al. | |
| 8,502,513 | B2 | 8/2013 | Imura | |
| 10,025,334 | B1 | 7/2018 | Derman | |
| 2005/0040796 | A1 | 2/2005 | Sutardja | |
| 2005/0189931 | A1 | 9/2005 | Ishino | |
| 2006/0038710 | A1 | 2/2006 | Staszewski et al. | |
| 2007/0152742 | A1 | 7/2007 | Rincon-Mora et al. | |
| 2008/0211313 | A1 * | 9/2008 | Nakamura | G05F 1/56 307/75 |
| 2008/0224680 | A1 | 9/2008 | Suzuki | |
| 2009/0085535 | A1 | 4/2009 | Wei | |
| 2009/0085610 | A1 | 4/2009 | Westwick | |
| 2009/0085619 | A1 | 4/2009 | Westwick et al. | |
| 2009/0085651 | A1 | 4/2009 | Liu et al. | |
| 2009/0085684 | A1 | 4/2009 | Guo et al. | |

(Continued)

FOREIGN PATENT DOCUMENTS

| | | | |
|---|---|---|---|
| EP | 2560063 | A1 | 2/2013 |
| WO | 0135640 | A2 | 5/2001 |
| WO | 15139053 | A1 | 9/2015 |

*Primary Examiner* — Matthew V Nguyen
(74) *Attorney, Agent, or Firm* — Kligler & Associates

(57) ABSTRACT

An electronic circuit for voltage regulation includes a voltage regulator and a recovery boosting circuit. The recovery boosting circuit is configured to detect a voltage drop occurring in an output voltage of the voltage regulator, to generate (i) a first electrical current that is derived from the output voltage of the voltage regulator and (ii) a second electrical current that is derived from a supply voltage of the voltage regulator, to generate a pulse whose energy depends on the first electrical current and on the second electrical current, and to assist the voltage regulator in recovering from the voltage drop, by applying the pulse to the voltage regulator.

19 Claims, 7 Drawing Sheets

(56) References Cited

U.S. PATENT DOCUMENTS

| | | | | |
|---|---|---|---|---|
| 2009/0085685 | A1 | 4/2009 | Guo et al. | |
| 2009/0086517 | A1 | 4/2009 | Wei et al. | |
| 2009/0089599 | A1 | 4/2009 | Westwick et al. | |
| 2009/0278609 | A1 | 11/2009 | Srinivasan et al. | |
| 2009/0315484 | A1 | 12/2009 | Cegnar et al. | |
| 2010/0166228 | A1 | 7/2010 | Steele et al. | |
| 2010/0277148 | A1 | 11/2010 | Zhao et al. | |
| 2011/0022859 | A1 | 1/2011 | More et al. | |
| 2011/0298280 | A1 | 12/2011 | Homol et al. | |
| 2011/0309760 | A1 | 12/2011 | Beland et al. | |
| 2012/0069606 | A1 | 3/2012 | Sagneri et al. | |
| 2012/0229202 | A1 | 9/2012 | Nikolov et al. | |
| 2013/0094414 | A1 | 4/2013 | Park et al. | |
| 2014/0218007 | A1* | 8/2014 | Vogman ..... | G06F 11/3024 324/76.11 |
| 2014/0239929 | A1 | 8/2014 | Fiocchi et al. | |
| 2014/0253069 | A1 | 9/2014 | Utsunomiya | |
| 2014/0253076 | A1 | 9/2014 | Utsunomiya | |
| 2014/0354249 | A1 | 12/2014 | Kurozo et al. | |
| 2015/0168971 | A1 | 6/2015 | Tomioka et al. | |
| 2015/0188402 | A1 | 7/2015 | Panigrahi | |
| 2015/0286231 | A1 | 10/2015 | Gerber et al. | |
| 2016/0227614 | A1* | 8/2016 | Lissoni ..... | H05B 33/0815 |
| 2016/0357205 | A1 | 12/2016 | Sanasi et al. | |

* cited by examiner

LDO REGULATOR WITH OUTPUT-DROP RECOVERY

FIELD OF THE INVENTION

The present invention relates generally to power supply circuitry, and particularly to methods and systems for voltage regulation with output-drop recovery.

BACKGROUND OF THE INVENTION

Low-dropout (LDO) voltage regulators are in common use in power supplies of electronic circuits. Various LDO configurations are known in the art. For example, U.S. Pat. No. 7,199,565 describes an LDO voltage regulator that includes a startup circuit, a curvature corrected bandgap circuit, an error amplifier, a metal oxide semiconductor (MOS) pass device and a voltage slew rate efficient transient response boost circuit. The MOS pass device has a gate node which is coupled to the output of the error amplifier, and a drain node for generating the output voltage. The voltage slew rate efficient transient response boost circuit applies a voltage to the gate node of the MOS pass device to accelerate the response time of the error amplifier in enabling the LDO voltage regulator to reach its final regulated output voltage when an output voltage drop occurs in the LDO voltage regulator.

SUMMARY OF THE INVENTION

An embodiment of the present invention that is described herein provides an electronic circuit for voltage regulation, including a voltage regulator and a recovery boosting circuit. The recovery boosting circuit is configured to detect a voltage drop occurring in an output voltage of the voltage regulator, to generate (i) a first electrical current that is derived from the output voltage of the voltage regulator and (ii) a second electrical current that is derived from a supply voltage of the voltage regulator, to generate a pulse whose energy depends on the first electrical current and on the second electrical current, and to assist the voltage regulator in recovering from the voltage drop, by applying the pulse to the voltage regulator.

In some embodiments, the voltage regulator includes a low-dropout (LDO) regulator having two stages, and the recovery boosting circuit is configured to apply the pulse between the two stages.

In some embodiments, the voltage regulator includes an output stage having a resistor ladder, and the recovery boosting circuit is configured to detect the voltage drop by comparing first and second voltages taken from respective branches of the resistor ladder. In an example embodiment, the recovery boosting circuit includes (i) a low-pass filter configured to filter the first voltage, and (ii) a comparator configured to detect the voltage drop by comparing the filtered first voltage and the second voltage.

In a disclosed embodiment, the energy of the pulse depends on a sum of the first electrical current and the second electrical current. In another embodiment, the recovery boosting circuit includes a cutoff circuit that is configured to cut-off the pulse following a duration that depends on the first electrical current and the second electrical current.

In yet another embodiment, the recovery boosting circuit includes a native Field-Effect Transistor (FET) that is configured to compensate for variations in the pulse caused by differences in the supply voltage. In still another embodiment, the recovery boosting circuit includes a series-connected capacitor configured to be charged with the pulse, and then discharge so as to apply the pulse to the voltage regulator. In another embodiment, the recovery boosting circuit includes a native Field-Effect Transistor (FET) whose drain is connected to the voltage regulator for applying the pulse.

There is additionally provided, in accordance with an embodiment of the present invention, a method for voltage regulation, including detecting a voltage drop occurring in an output voltage of a voltage regulator, and generating (i) a first electrical current that is derived from the output voltage of the voltage regulator, and (ii) a second electrical current that is derived from a supply voltage of the voltage regulator. A pulse, whose energy depends on the first electrical current and on the second electrical current, is generated. The voltage regulator is assisted in recovering from the voltage drop, by applying the pulse to the voltage regulator.

There is further provided, in accordance with an embodiment of the present invention, an Integrated Circuit (IC) including electronic circuitry, and voltage regulation circuitry configured to generate an output voltage for powering the electronic circuitry. The voltage regulation circuitry includes a voltage regulator configured to generate the output voltage, and a recovery boosting circuit configured to detect a voltage drop occurring in the output voltage of the voltage regulator, generate (i) a first electrical current that is derived from the output voltage of the voltage regulator and (ii) a second electrical current that is derived from a supply voltage of the voltage regulator, generate a pulse whose energy depends on the first electrical current and on the second electrical current, and assist the voltage regulator in recovering from the voltage drop, by applying the pulse to the voltage regulator.

The present invention will be more fully understood from the following detailed description of the embodiments thereof, taken together with the drawings in which:

DETAILED DESCRIPTION OF EMBODIMENTS

Overview

Embodiments of the present invention that are described herein provide improved methods and apparatus for voltage regulation. The disclosed techniques improve the recovery of voltage regulators from output voltage drops that may be caused, for example, by sudden changes in load conditions.

The disclosed techniques are highly effective in avoiding overshoot during recovery from voltage drop, and perform well over a large range of supply voltages.

In some embodiments, an electronic circuit comprises a two-stage Low-Dropout (LDO) voltage regulator, and a Recovery Boost Unit (RBU). The RBU is configured to detect a voltage drop occurring in the output voltage of the LDO, to generate a pulse in response to the detected voltage drop, and to assist the LDO in recovering from the voltage drop by applying the pulse to a mid-point between the two LDO stages. The pulse typically assists current draw from the output of the first LDO stage, and therefore increases the speed with which the LDO is able to respond to the voltage drop.

In some disclosed embodiments, the RBU sets the energy of the pulse (e.g., the pulse amplitude and/or duration) depending on (i) the actual output voltage including the voltage drop, and (ii) the actual supply voltage. In an embodiment, the RBU generates (i) a first electrical current that is derived from the output voltage of the LDO, and (ii) a second electrical current that is derived from the supply voltage. The dependency is typically an inverse dependence, i.e., a lower output voltage and/or a lower supply voltage is translated to a stronger pulse, and vice versa. The RBU generates the pulse based on these two currents.

By generating the pulse in this manner, the pulse energy matches the actual characteristics of the voltage drop (due to the dependence on the first electrical current). Recovery is therefore fast and accurate, and with little or no overshoot. Moreover, the recovery speed and accuracy is achieved over a large range of supply voltages (due to the dependence of the pulse on the second electrical current).

Moreover, the disclosed technique serves as a built-in protection mechanism that practically disables the RBU during transition events of the LDO, such as wake-up or transition from sleep mode to normal operation. The RBU reliability is thus improved significantly. The disclosed technique eliminates the need for adding dedicated protection hardware for this purpose, thus reducing size and cost.

Other advantageous features that assist in achieving high performance are, for example, the use of native Field-Effect Transistors (FETs), and detecting the voltage drop using a pair of voltages taken from the same resistor ladder that is also used for outputting the LDO output voltage. These features, and several example implementations of the RBU, are described and explained below.

System Description

Figure 1:
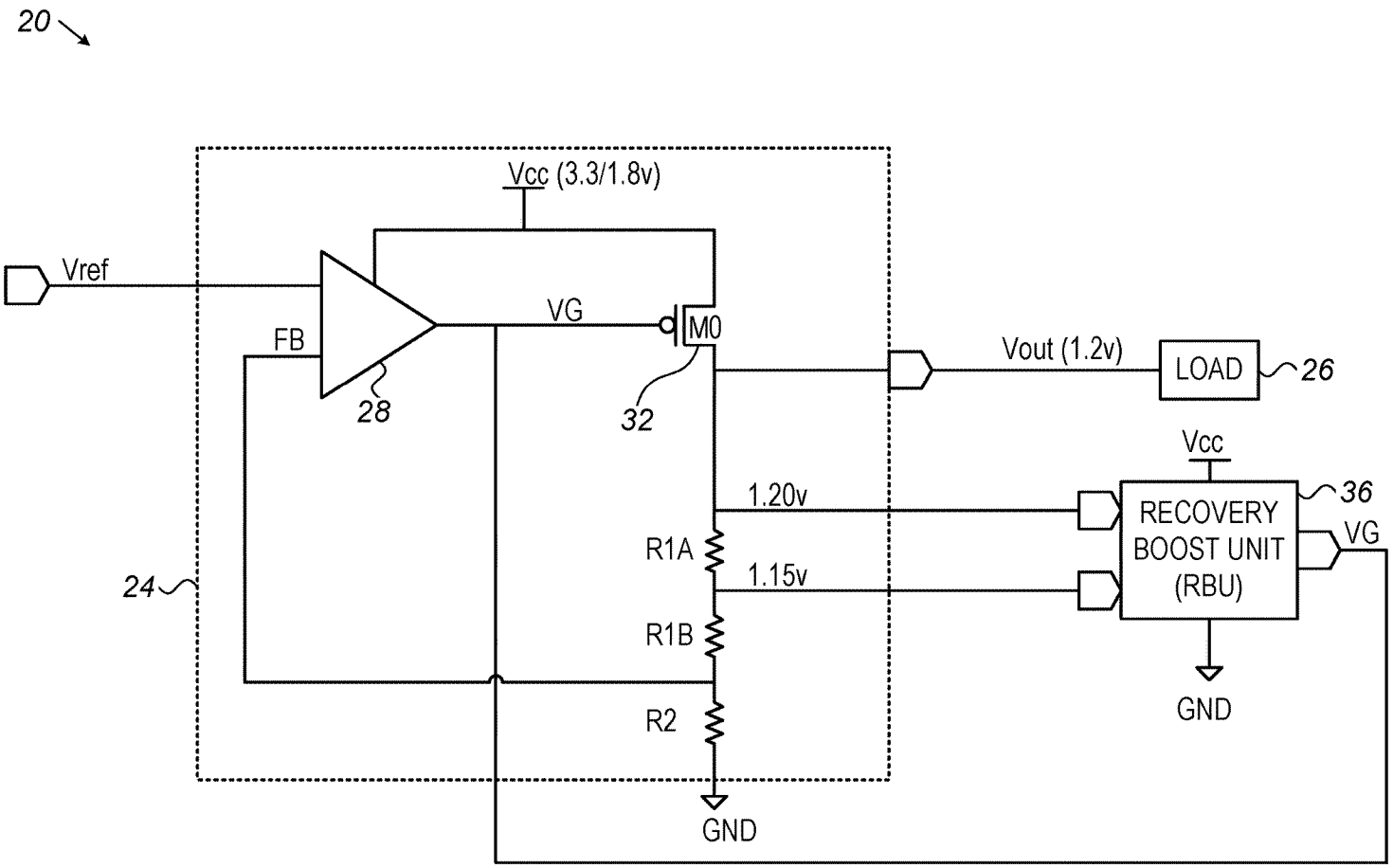
FIG. 1 is a block diagram that schematically illustrates an LDO voltage regulator with improved output-drop recovery, in accordance with an embodiment of the present invention.

FIG. 1 is a block diagram that schematically illustrates an electronic circuit 20 comprising an LDO voltage regulator 24 with improved output-drop recovery, in accordance with an embodiment of the present invention. LDO 24 supplies electrical power to a load 26, which may comprise any suitable circuitry. In many practical scenarios, sudden changes in the current consumption of load 26 cause voltage drops in the output voltage of LDO 24. It is typically important to recover from such voltage drops rapidly and with little or no overshoot. The output-drop recovery schemes described herein assist LDO 24 in performing such recovery.

Circuit 20 can be used in a wide variety of systems that require regulated power supply under varying load conditions. One typical use-case is in a controller or other Integrated Circuit (IC) that switches between a sleep mode and a normal mode.

In the embodiment of FIG. 1, LDO 24 comprises a two-stage LDO. The first stage comprises a differential amplifier, in the present example an Operational Transconductance Amplifier (OTA) 28. The second stage comprises a P-type Metal-Oxide-Semiconductor Field-Effect Transistor (PMOS FET) 32, denoted Ml in the figure. Both stages are connected to a supply voltage denoted Vcc.

In the present example, VCC varies in the range 1.8-3.3V. In some embodiments, an extended range of approximately 1.7-3.6V is considered. The regulated output voltage produced by LDO 24 is denoted Vout, in the present example 1.2V.

The output of OTA 28 is used for driving the gate of PMOS 32. This mid-point between the two stages is denoted VG. The output voltage Vout is taken from the source of PMOS 32. The drain of PMOS 32 is connected to Vcc. The source of PMOS 32 (from which Vout is taken) is connected to ground via a resistor ladder, in the present example comprising three resistors R1A, R1B and R2 connected in series. A feedback voltage FB is taken from the junction of R1B and R2, and fed back to one of the differential inputs of OTA 28. The other differential input of OTA 28 is connected to a reference voltage Vref. Vref may be produced, for example, by a bandgap voltage reference (not shown).

Circuit 20 further comprises a recovery boosting circuit 36, also referred to herein as a Recovery Boost Unit (RBU). RBU 36 detects voltage drops occurring in Vout and, in response to detecting a voltage drop, generates a current pulse at junction VG. The energy (e.g., amplitude and/or duration) and the timing of the pulse match the characteristics of the detected voltage drop. The pulse assists rapid discharge of current from junction VG, beyond the capabilities of OTA 28. (Specifically, in a system that is specified to operate at a low supply voltage of 1.8V, the current of the OTA output branch is typically restricted in order to keep the OTA below saturation.) As a result, the bandwidth of the LDO feedback loop is increased considerably during the pulse. The pulse generated by the RBU is thus also referred to as a "discharge pulse."

Figure 6:
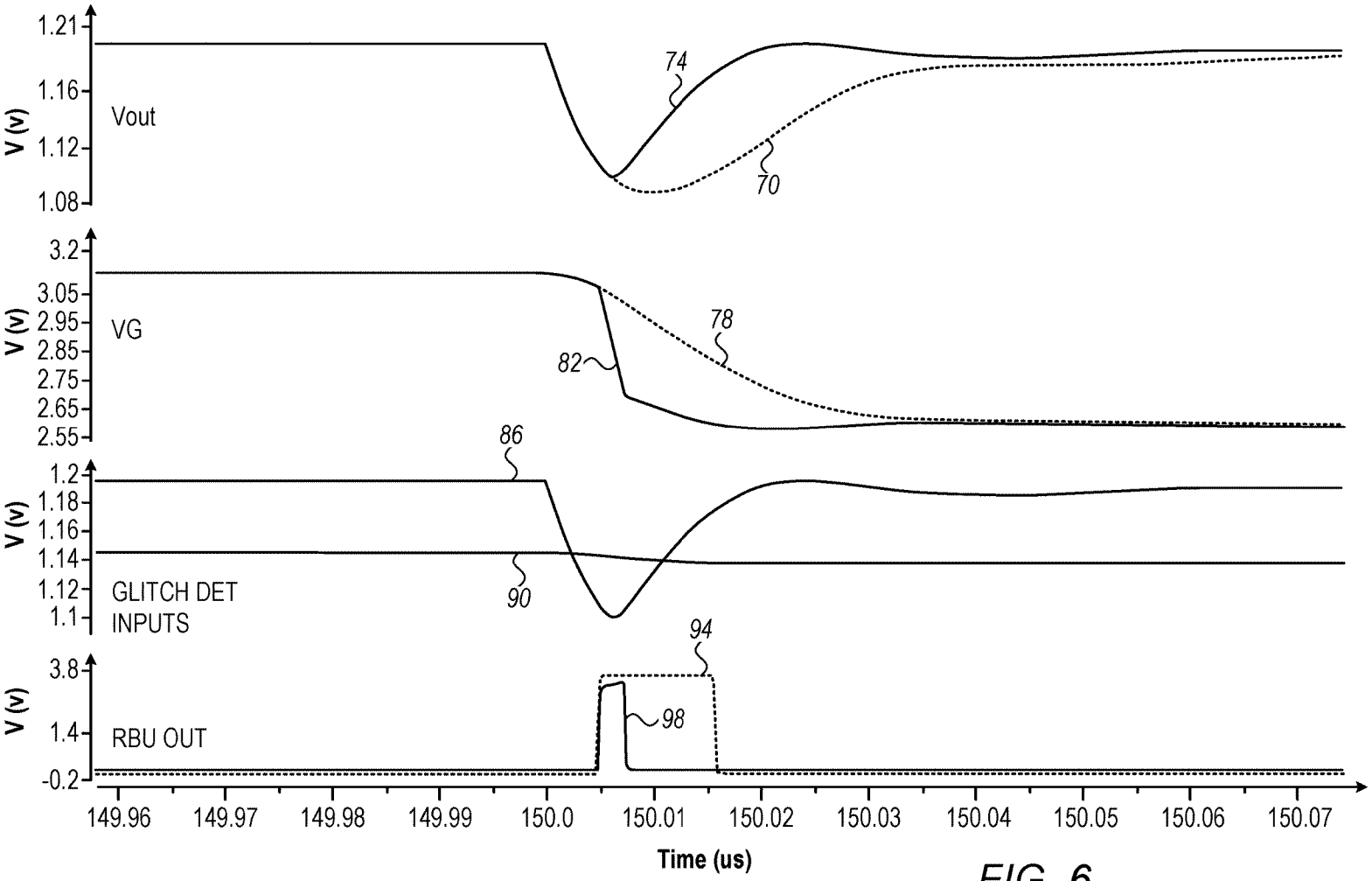
FIG. 6 is a graph showing simulated performance of an LDO voltage regulator with and without improved output-drop recovery, in accordance with an embodiment of the present invention.

The presence of the pulse improves the recovery of LDO 24 from the voltage drop. Typically, when assisted by the pulse generated by RBU 36, the voltage drop in Vout is smaller in depth, and the return to normal output voltage is faster. Note that the energy of the pulse has a considerable impact on the recovery performance. If the pulse energy is too small, recovery will be relatively slow. If the pulse energy is too high, an overshoot may develop in Vout. As will be explained below, due to the accurate setting of the pulse energy using the disclosed techniques, recovery is fast and has little or no overshoot. This performance is achievable over a wide range of Vcc, e.g., between 1.8-3.3V. Example simulated performance, with and without the assistance of RBU 36, is shown in FIG. 6 below.

In addition to Vcc and ground, RBU 36 has two inputs and one output. The two inputs, denoted 1.20V and 1.15V in the figure, are taken from two different branches of the resistor ladder of LDO 24. The input denoted 1.20V is equal to Vout. The resistances in the resistor ladder are designed such that the second input, denoted 1.15V, is 50 mV below Vout. The generated discharge pulse is provided from the output of RBU 36 to junction VG (the output of OTA, which is the gate of PMOS 32, i.e., the mid-point between the two stages of LDO 24).

Taking both the 1.20V input and the 1.15V input from the resistor ladder is advantageous for several reasons. First, the two inputs are well matched to one another. Second, Vref is not loaded or used for providing these inputs. Third, glitch detection is performed directly on the Vout (1.20V) node itself, improving the speed and reliability of detection.

Example RBU Configurations

Figure 2:
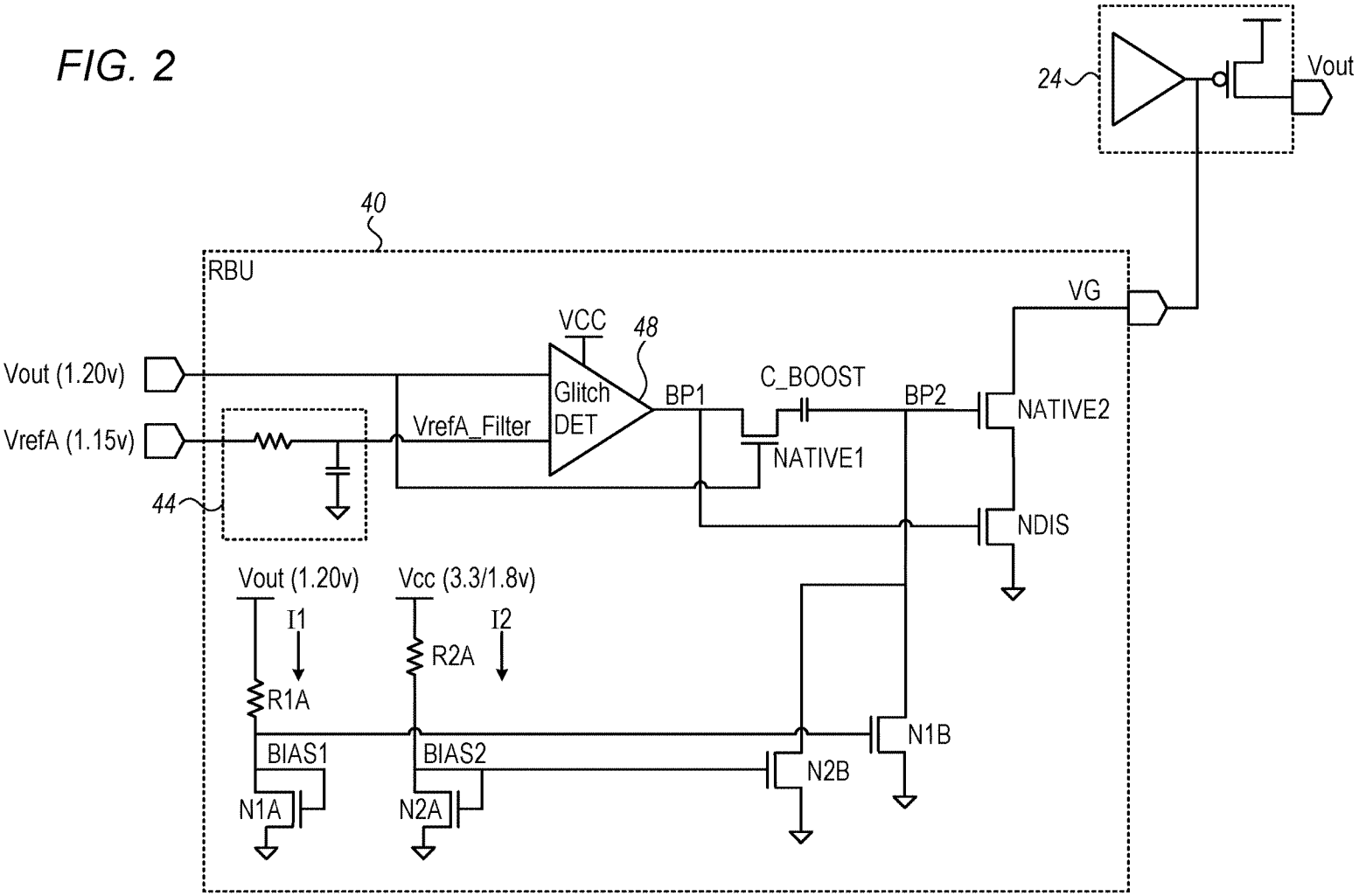
FIGS. 2-4 are block diagrams that schematically illustrate Recovery Boost Units (RBUs) for use with the LDO voltage regulator of FIG. 1, in accordance with embodiments of the present invention.

FIG. 2 is a block diagram that schematically illustrates an RBU 40, in accordance with an embodiment of the present invention. This configuration can be used for implementing RBU 36 of FIG. 1.

RBU 40 receives as input two voltages—Vout, and VrefA that is lower than Vout by 50 mV. When a voltage drop occurs in Vout, VrefA also exhibits this voltage drop. VrefA, however, is filtered by a Low-Pass Filter (LPF) 44, in the present example a resistance-capacitance (RC) filter. Due to the low-pass filtering, the output of LPF 44 (denoted VrefA_Filter) is approximately constant at 1.15V, even during voltage drops in Vout.

A glitch detector 48, typically comprising a high-speed comparator, is used for detecting the voltage drops in Vout. Glitch detector 48 compares Vout with VrefA_Filter (the low-pass filtered version of VrefA, which is 50 mV below Vout). Whenever the instantaneous amplitude of Vout drops by more than 50 mV, the output of glitch detector 48 becomes high (equal to Vcc). Otherwise, the output of glitch detector 48 is low (0V). The output of glitch detector 48 is denoted BP1. In other words, glitch detector 48 outputs a pulse of amplitude Vcc that begins when the voltage drop becomes deeper than 50 mV.

In the embodiment of FIG. 2, RBU 40 comprises a native N-type Metal-Oxide-Semiconductor Field-Effect Transistor (NMOS FET) denoted NATIVE'. The gate of NATIVE1 is connected to Vout, and the drain of NATIVE1 is connected to BP'. The function of NATIVE1 is to clip the amplitude of the pulse at the output of glitch detector 48 from Vcc to approximately Vout (1.2V), regardless of the actual value of Vcc. This operation assists in matching the pulse to the characteristics of the voltage drop, across a wide range of supply voltages.

The source of NATIVE1 is connected to a capacitor denoted C_BOOST, which couples the clipped pulse to the gate of another native NMOS FET denoted NATIVE2. C_BOOST charges rapidly when the pulse begins, and then discharges gradually.

The drain of NATIVE2 is connected to point VG (between the two stages of LDO 24). The source of NATIVE2 is connected to ground via an additional NMOS FET denoted NDIS. NATIVE2 operates as a switch, which is opened and closed by the pulse at BP2. When closed, RBU 40 draws current from VG, assisting LDO to recover from the voltage drop as explained above. The gate of transistor NDIS is connected to BP1, i.e., to the output of glitch detector 48. Transistor NDIS is used for terminating the pulse when the output of glitch detector 48 becomes low (when the voltage drop becomes smaller than 50 mV).

Native transistors are particularly suitable for clipping the pulse (as performed by NATIVE1) and for switching current in response to the pulse (as performed by NATIVE2), since they have a threshold voltage of approximately zero. The use of the native transistor NATIVE2 is especially suitable since it has a relatively low input gate voltage of 1.2V (which is the outcome of clipping by NATIVE1, regardless of the wide range of supply voltage). Moreover, a native transistor typically has a very small physical area, and at the same time is able to provide high current. Nevertheless, the disclosed technique is not limited to implementation using a native transistor, and other suitable types of transistors can be used in alternative embodiments.

In an alternative embodiment, transistor NDIS may be omitted. In such an embodiment, it is typically desired that the off current of NATIVE2 be negligible.

In the present embodiment, RBU 40 further comprises two current sources that are configured to generate two electrical currents denoted I1 and I2. The current source of I1 comprises an NMOS FET denoted N1A and a resistor R1A. This current source is fed by Vout, and therefore I1 depends on Vout. In particular, I1 exhibits a current drop whenever Vout exhibits a voltage drop. The current source of I2 comprises an NMOS FET denoted N2A and a resistor R2A. This current source is fed by Vcc, and therefore I2 depends on Vcc.

RBU 40 comprises two current mirrors implemented using NMOS FETs N1B and N2B. N1B and N2B mirror currents I1 and I2 using bias voltages BIAS1 and BIAS2, respectively. The sum of the two currents (I1+I2) is applied to BP2. Put in another way, node BP2 is discharged using the two current sources.

The energy of the discharge pulse, which discharges BP2, depends on both Vout and Vcc. The dependence is typically an inverse dependence, i.e., lower Vout and/or lower Vcc is translated to a higher-energy pulse, and vice versa. More specifically, the energy of the discharge pulse, which defines the VG discharge current strength, follows the Vout state during the actual Vout drop event, and acts as a real-time negative feedback for the discharge pulse. The energy of the discharge pulse fades slowly as the Vout drop grows deeper and/or longer, and fades rapidly as the Vout drop recovers.

This kind of dependence thus causes the pulse energy to match the actual characteristics of the voltage drop in Vout in real-time and over a wide range of Vcc. Therefore, recovery from the voltage drop is rapid and with little or no overshoot.

As noted above, the disclosed techniques acts as a built-in protection mechanism against undesired VG discharge during transition events of LDO 24 (e.g., wakeup or transition from sleep mode to normal operation). During such transition events, the levels of Vout and VrefA may not be well stabilized and may undesirably activate glitch detector 48 to produce a "1" output until LDO 24 is stable. The derived discharge pulse, however, is very short relative to the transition event (e.g., wake-up time), and therefore keeps the glitch detector output at "0" for most of the transition event, keeping LDO 24 stable.

Moreover, since Vout and VrefA are taken from the same resistor ladder, Vout is guaranteed to be higher than VrefA by design. This guarantee holds during transition events, as well.

Figure 3:
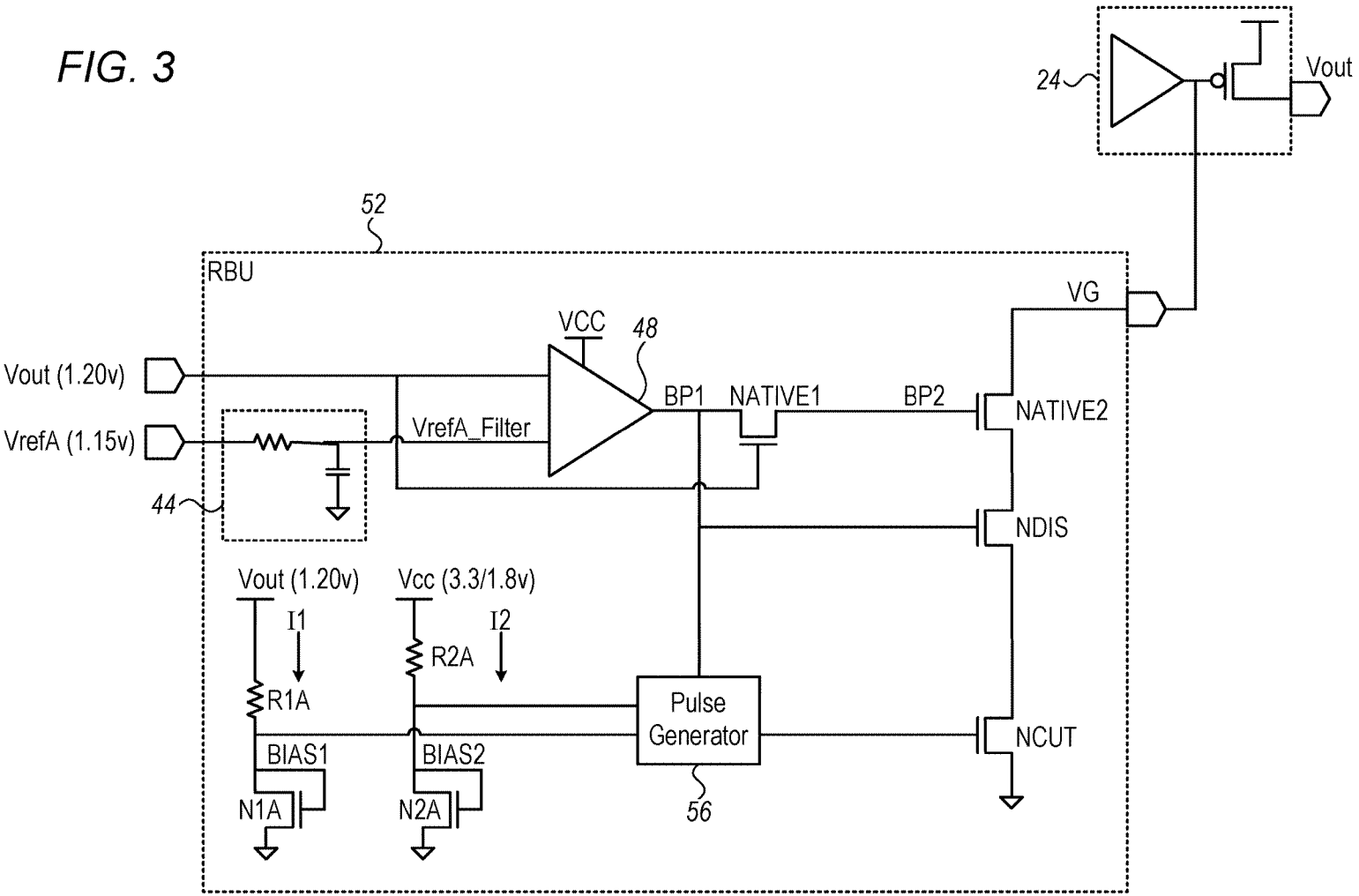

FIG. 3 is a block diagram that schematically illustrates an RBU 52, in accordance with another embodiment of the present invention. This configuration can also be used for implementing RBU 36 of FIG. 1. RBU 52 is similar in structure and operation to RBU 40 of FIG. 2, except for the following differences.

A first difference is that capacitor C_BOOST is omitted in the present implementation of the RBU.

A second difference is that in the present embodiment, a pulse generator 56 generates the pulse based on I1, I2 and the output of glitch detector 48. Typically, pulse generator 56 is triggered by the output of glitch detector 48. When triggered, the pulse generator generates a pulse whose duration depends on I1+I2. This pulse controls a NMOS FET denoted NCUT, which is connected drain-to-source in series with NATIVE2 and NDIS. Using NCUT, pulse generator 56 enables the pulse when the output of the glitch detector becomes high, and disables the pulse after the desired duration.

The RBU configurations of FIGS. 2 and 3 also differ from one another in the shape of the discharge pulse. The pulse generated by RBU 36 (FIG. 2) typically has a monotonically-decreasing amplitude. The pulse generated by RBU 40 (FIG. 3) has an approximately constant amplitude.

Figure 4:
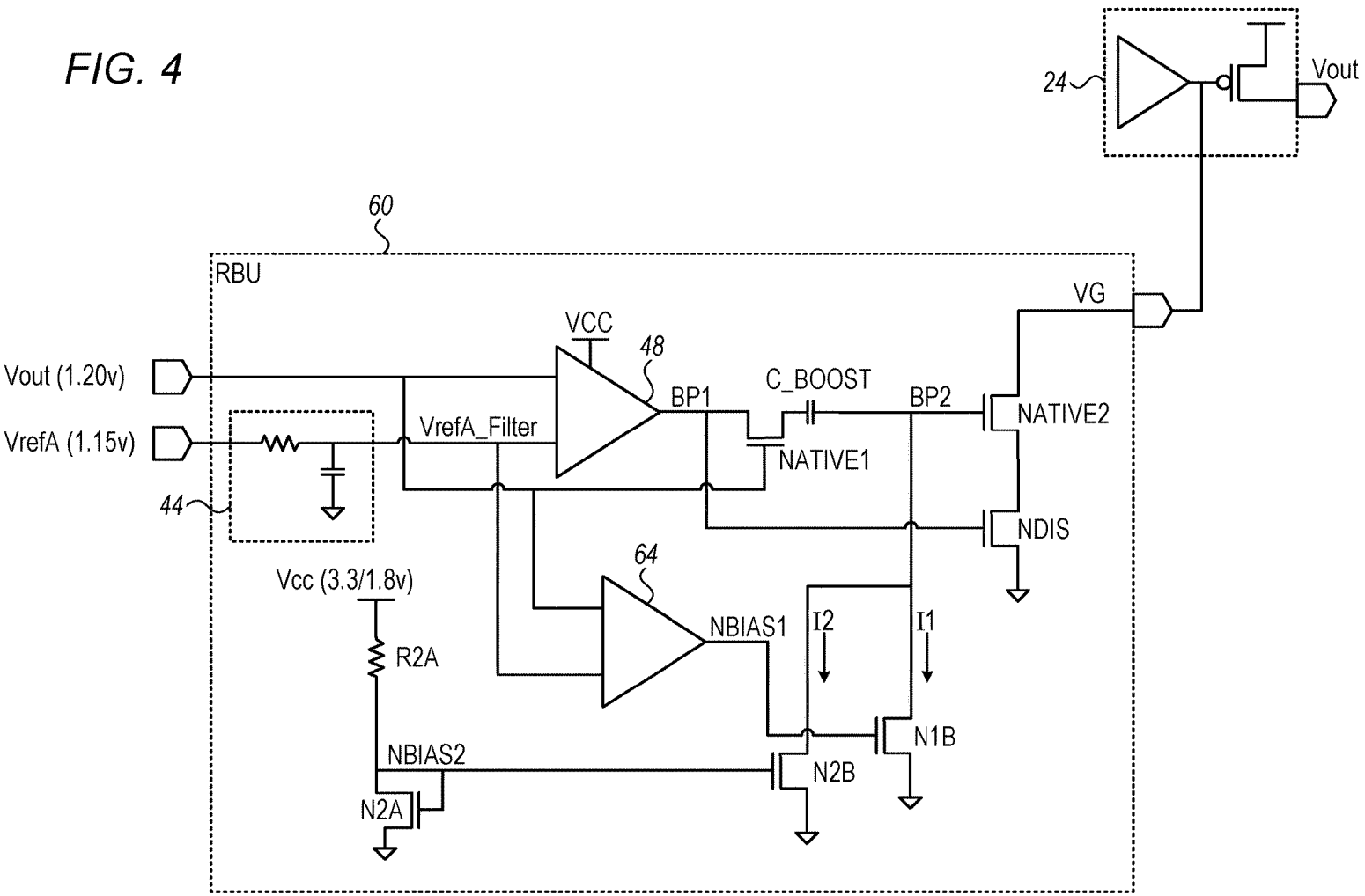

FIG. 4 is a block diagram that schematically illustrates an RBU 60, in accordance with another embodiment of the present invention. This configuration, too, can be used for implementing RBU 36 of FIG. 1. The example of FIG. 4 shows yet another way of controlling the pulse energy as a function of I1 and I2 (and thus as a function of Vout and Vcc).

In the present example, I2 is generated and mirrored to BP2 as in RBU 40 of FIG. 2. For generating I1, on the other hand, RBU 60 comprises a differential current amplifier 64 (typically an operational amplifier, acting as an error amplifier). The two differential inputs of amplifier 64 are connected to Vout and to VrefA_Filter. A voltage NBIAS1 is taken from the current-branch output of amplifier 64. NBIAS1 depends on the depth of the voltage drop in Vout. Voltage NBIAS1 is used for mirroring I1 to BP2 using NMOS N1B.

Figure 5:
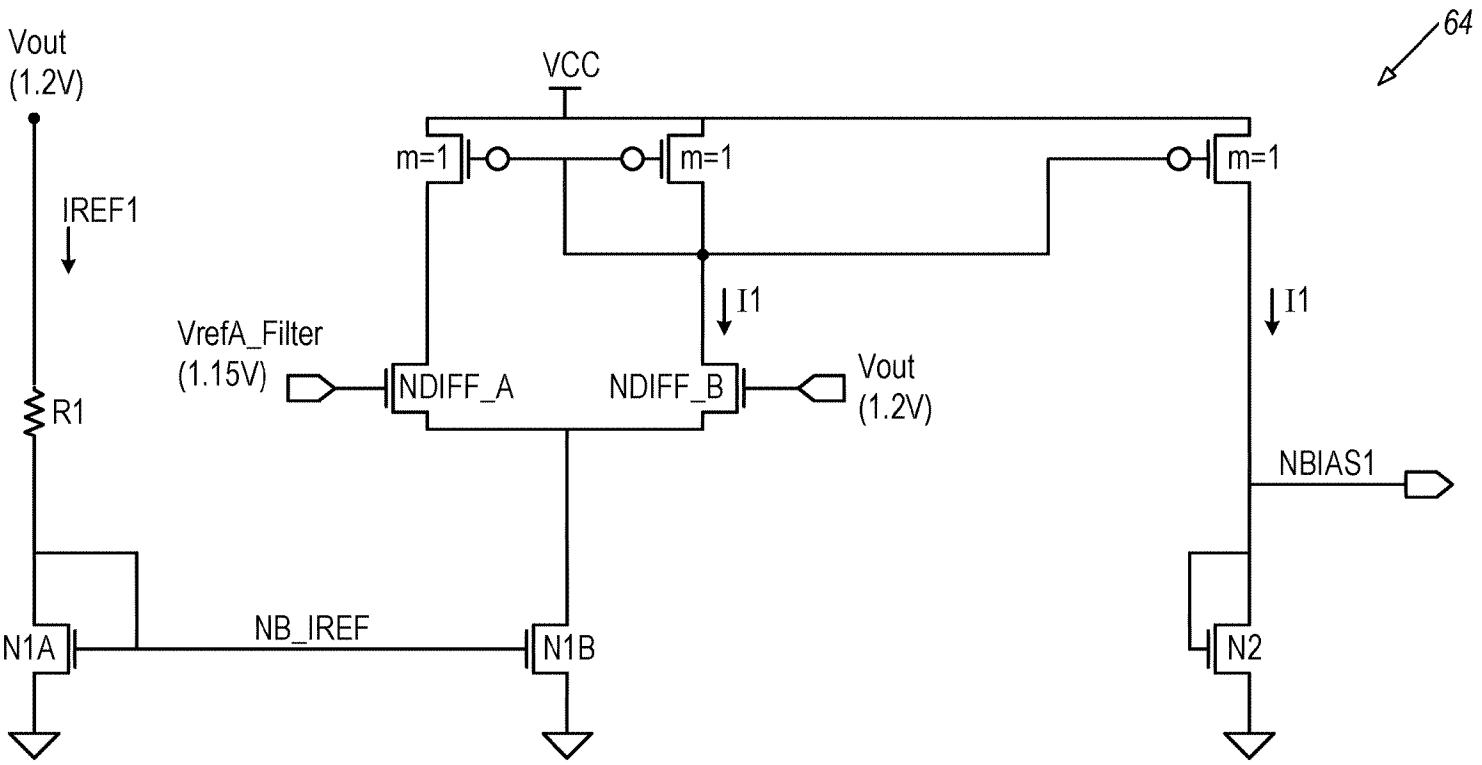
FIG. 5 is circuit diagram of a differential amplifier used in the RBU of FIG. 4, in accordance with an embodiment of the present invention.

FIG. 5 is circuit diagram of amplifier 64 used in RBU 60 of FIG. 4, in accordance with an embodiment of the present invention. Amplifier 64 is used for generating current I1, with a high gain, tracking the real-time waveform of the Vout voltage drop. Amplifier 64 is a differential amplifier with an active load.

The right-hand-side branch has a high impedance, whereas the left-hand-side branch (the drain of the left-hand-side differential device, also equal to NBIAS1) has a low impedance. The left-hand-side branch has a low voltage gain (since it is diode connected), but nevertheless has a high current gain that depends on the differential gain (Vout-VrefA_Filter).

For this reason, NBIAS1 is well gained and closely follows the transient fluctuations in Vout (or in Vout-VrefA_Filter) during the Vout drop event. Therefore, NBIAS1 is highly suited to serve as a current source for the current mirror N1B, which varies its current in the same manner as I1 but with larger gain.

Simulated Performance

FIG. 6 is a graph showing simulated performance of an LDO voltage regulator with and without improved output-drop recovery, in accordance with an embodiment of the present invention. In the present example, the configuration of FIG. 3 (with pulse generator 56) was used for the simulation. All graphs show voltage as a function of time.

Starting from the top of the figure, a curve 70 shows Vout without improved output-drop recovery (RBU inactive). A deep and long voltage drop is clearly visible. A curve 74 shows Vout with improved output-drop recovery (RBU active). As can be seen, the voltage drop is considerably shorter and shallower.

Further down, curves 78 and 82 show the voltage at VG (mid-point between the two LDO stages) with and without improved output-drop recovery, respectively. Without improved output-drop recovery (curve 78), the transition in VG is slow (narrow bandwidth feedback). With improved output-drop recovery (curve 82), the transition in VG is significantly faster (high bandwidth feedback), due to the improved current draw from point VG facilitated by the RBU.

Further down, curves 86 and 90 show the two inputs to glitch detector 48. Curve 86 shows Vout, and curve 90 shows VrefA_Filter. Glitch detector 48 outputs a pulse between the time curve 86 drops below curve 90, until the time curve 86 rises back above curve 90.

Finally, at the bottom of the figure, a curve 94 shows the pulse at the output of glitch detector 48. A curve 98 shows the RBU output, i.e., the pulse applied to point VG, after termination of the pulse by using pulse generator 56 and transistor NCUT.

Figure 7:
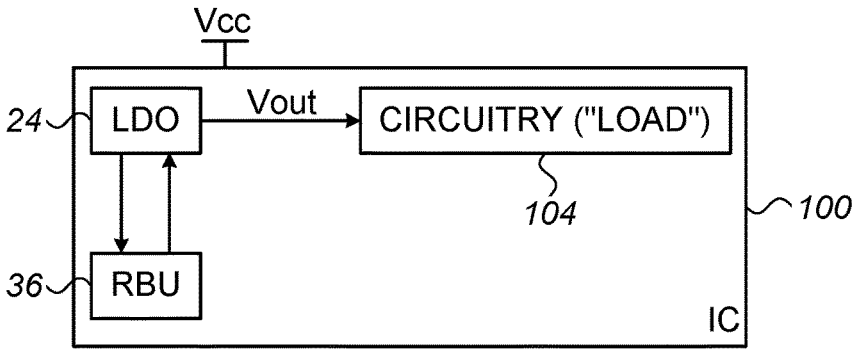
FIG. 7 is a block diagram that schematically illustrates an Integrated Circuit (IC) comprising an LDO voltage regulator with improved output-drop recovery, in accordance with an embodiment of the present invention.

FIG. 7 is a block diagram that schematically illustrates an Integrated Circuit (IC) 100 comprising an LDO voltage regulator with improved output-drop recovery, in accordance with an embodiment of the present invention. In this example, LDO 24 is used for providing regulated voltage Vout that powers circuitry 104. RBU 36 is used for improving the recovery of LDO 24 from voltage drops in Vout, as explained herein. Note that, other than assisting in recovery from output drop, RBU 36 does not impact the performance, stability or operating point of LDO 24 in any way, and does not add any considerable capacitive load to the LDO.

The circuit configurations shown in FIGS. 1-5 and 7 are example configurations that are chosen for the sake of conceptual clarity. In alternative embodiments, any other suitable configurations can be used. For example, the disclosed techniques can be used with other types of voltage regulators, not necessarily with two-stage LDOs. The RBU configurations described in FIGS. 2-4, too, are depicted purely by way of example. In alternative embodiments, any other suitable RBU configuration can be used.

In various embodiments, the circuits shown in FIGS. 1-5 and 7 may be fabricated in any suitable way, e.g., using discrete components or in an Application-Specific Integrated Circuit (ASIC). The numerical values given above, e.g., the value of Vout, Vcc ranges and values of the RBU inputs, are chosen purely by way of example. The disclosed techniques can be used with any other suitable values.

It will thus be appreciated that the embodiments described above are cited by way of example, and that the present invention is not limited to what has been particularly shown and described hereinabove. Rather, the scope of the present invention includes both combinations and sub-combinations of the various features described hereinabove, as well as variations and modifications thereof which would occur to persons skilled in the art upon reading the foregoing description and which are not disclosed in the prior art. Documents incorporated by reference in the present patent application are to be considered an integral part of the application except that to the extent any terms are defined in these incorporated documents in a manner that conflicts with the definitions made explicitly or implicitly in the present specification, only the definitions in the present specification should be considered.

The invention claimed is:

1. An electronic circuit for voltage regulation, comprising:

a voltage regulator; and a recovery boosting circuit, which is configured to:

detect a voltage drop occurring in an output voltage of the voltage regulator;

generate (i) a first electrical current that is derived from the output voltage of the voltage regulator, and (ii) a second electrical current that is derived from a supply voltage of the voltage regulator;

generate a pulse whose energy depends on the first electrical current and on the second electrical current; and assist the voltage regulator in recovering from the voltage drop, by applying the pulse to the voltage regulator.

2. The electronic circuit according to claim 1, wherein the voltage regulator comprises a low-dropout (LDO) regulator having two stages, and wherein the recovery boosting circuit is configured to apply the pulse between the two stages.

3. The electronic circuit according to claim 1, wherein the voltage regulator comprises an output stage having a resistor ladder, and wherein the recovery boosting circuit is configured to detect the voltage drop by comparing first and second voltages taken from respective branches of the resistor ladder.

4. The electronic circuit according to claim 3, wherein the recovery boosting circuit comprises:

a low-pass filter configured to filter the first voltage; and a comparator configured to detect the voltage drop by comparing the filtered first voltage and the second voltage.

5. The electronic circuit according to claim 1, wherein the energy of the pulse depends on a sum of the first electrical current and the second electrical current.

6. The electronic circuit according to claim 1, wherein the recovery boosting circuit comprises a cutoff circuit that is configured to cut-off the pulse following a duration that depends on the first electrical current and the second electrical current.

7. The electronic circuit according to claim 1, wherein the recovery boosting circuit comprises a native Field-Effect Transistor (FET) that is configured to compensate for variations in the pulse caused by differences in the supply voltage.

8. The electronic circuit according to claim 1, wherein the recovery boosting circuit comprises a series-connected capacitor configured to be charged with the pulse, and then discharge so as to apply the pulse to the voltage regulator.

9. The electronic circuit according to claim 1, wherein the recovery boosting circuit comprises a native Field-Effect Transistor (FET) whose drain is connected to the voltage regulator for applying the pulse.

10. A method for voltage regulation, comprising:

detecting a voltage drop occurring in an output voltage of a voltage regulator;

generating (i) a first electrical current that is derived from the output voltage of the voltage regulator, and (ii) a second electrical current that is derived from a supply voltage of the voltage regulator;

generating a pulse whose energy depends on the first electrical current and on the second electrical current; and assisting the voltage regulator in recovering from the voltage drop, by applying the pulse to the voltage regulator.

11. The method according to claim 10, wherein the voltage regulator comprises a low-dropout (LDO) regulator having two stages, and wherein applying the pulse to the voltage regulator comprises applying the pulse between the two stages.

12. The method according to claim 10, wherein the voltage regulator comprises an output stage having a resistor ladder, and wherein detecting the voltage drop comprises comparing first and second voltages taken from respective branches of the resistor ladder.

13. The method according to claim 12, wherein detecting the voltage drop comprises low-pass filtering the first voltage, and comparing the filtered first voltage and the second voltage.

14. The method according to claim 10, wherein the energy of the pulse depends on a sum of the first electrical current and the second electrical current.

15. The method according to claim 10, wherein generating the pulse comprises cutting-off the pulse following a duration that depends on the first electrical current and the second electrical current.

16. The method according to claim 10, wherein generating the pulse comprises compensating for variations in the pulse, which are caused by differences in the supply voltage, using a native Field-Effect Transistor (FET).

17. The method according to claim 10, wherein generating the pulse comprises charging a series-connected capacitor with the pulse, and wherein applying the pulse comprises discharging the series-connected capacitor so as to apply the pulse to the voltage regulator.

18. The method according to claim 10, wherein applying the pulse comprises applying the pulse using a native Field-Effect Transistor (FET) whose drain is connected to the voltage regulator.

19. An Integrated Circuit (IC), comprising:

electronic circuitry; and voltage regulation circuitry, which is configured to generate an output voltage for powering the electronic circuitry, the voltage regulation circuitry comprising:

a voltage regulator, configured to generate the output voltage; and a recovery boosting circuit, which is configured to:

detect a voltage drop occurring in the output voltage of the voltage regulator;

generate (i) a first electrical current that is derived from the output voltage of the voltage regulator, and (ii) a second electrical current that is derived from a supply voltage of the voltage regulator;

generate a pulse whose energy depends on the first electrical current and on the second electrical current; and assist the voltage regulator in recovering from the voltage drop, by applying the pulse to the voltage regulator.

* * * * *